US007999494B2

(12) United States Patent
Lin et al.

(10) Patent No.: US 7,999,494 B2
(45) Date of Patent: Aug. 16, 2011

(54) ELECTRONIC BALLAST WITH DIMMING CONTROL FROM POWER LINE SENSING

(75) Inventors: Ko-Ming Lin, Hsin-Chu (TW); Yen-Ping Wang, Hsin-Chu (TW); Pei-Yuan Chen, Hsin-Chu (TW); Wei-Chuan Su, Hsin-Chu (TW); Chia-Chieh Hung, Hsin-Chu (TW); Jian-Shen Li, Hsin-Chu (TW)

(73) Assignee: Grenergy Opto, Inc., Hsin-Chu (TW)

( * ) Notice: Subject to any disclaimer, the term of this patent is extended or adjusted under 35 U.S.C. 154(b) by 364 days.

(21) Appl. No.: 12/432,865

(22) Filed: Apr. 30, 2009

(65) Prior Publication Data

US 2010/0277100 A1 Nov. 4, 2010

(51) Int. Cl.
*H05B 41/36* (2006.01)

(52) U.S. Cl. ..... 315/307; 315/291

(58) Field of Classification Search ..... 315/209 R, 315/224, 225, 291, 294, 307, 308
See application file for complete search history.

(56) References Cited

U.S. PATENT DOCUMENTS

| | | | | |
|---|---|---|---|---|
| 5,798,620 | A * | 8/1998 | Wacyk et al. | 315/307 |
| 6,949,888 | B2 * | 9/2005 | Ribarich | 315/291 |
| 7,408,307 | B2 * | 8/2008 | Ribarich | 315/291 |
| 7,551,463 | B2 * | 6/2009 | Ros et al. | 363/89 |

* cited by examiner

*Primary Examiner* — Jacob Y Choi
*Assistant Examiner* — Jimmy Vu
(74) *Attorney, Agent, or Firm* — Ming Chow; Sinorica, LLC

(57) ABSTRACT

The present invention discloses an electronic ballast with dimming control from power line sensing for a fluorescent lamp, comprising: a line switching sensing circuit, used to generate a switching sensing signal by performing a voltage comparison operation on a DC voltage, and generate a reset signal according to the off time of the power line; a control voltage generator, used to generate a control voltage according to the count of said switching sensing signal; a voltage controlled oscillator, used to generate an oscillating signal according to the control voltage; and a non-overlapping driver, used to generate a high side driving signal and a low side driving signal according to the oscillating signal.

7 Claims, 7 Drawing Sheets

ELECTRONIC BALLAST WITH DIMMING CONTROL FROM POWER LINE SENSING

BACKGROUND OF THE INVENTION

1. Field of the Invention

The present invention relates to electronic ballasts, and more particularly to electronic ballasts with dimming control from power line sensing.

2. Description of the Related Art

In supplying power to light emitting devices such as fluorescent lamps or cold cathode fluorescent lamps or compact fluorescent lamps, electronic ballasts are widely adopted to keep the lamp current stable.

FIG. 1 shows the typical architecture of a prior art electronic ballast with dimming function for driving a fluorescent lamp. As shown in FIG. 1, the prior art electronic ballast with dimming function mainly comprises a full bridge rectifier 101, a $V_{CC}$ start-up circuit 102, a ballast control IC 103, an NMOS transistor 104, an NMOS transistor 105 and a voltage divider 106.

In the architecture, the full bridge rectifier 101 is used to rectify an AC line input voltage to generate a main input voltage $V_{IN}$.

The $V_{CC}$ start-up circuit 102, coupling to the main input voltage $V_{IN}$, is used to start up the generation of a DC voltage $V_{CC}$.

The ballast control IC 103 is used to generate a high side driving signal $V_{HS}$ for driving the NMOS transistor 104 and a low side driving signal $V_{LS}$ for driving the NMOS transistor 105 to deliver a current $I_{LMP}$ to the fluorescent lamp, in response to the voltage at the DIM input pin 3.

The NMOS transistor 104 and the NMOS transistor 105 are used for generating a square waveform to a LC resonant network. The LC resonant network then converts the square waveform to a current signal $I_{LMP}$ to drive the lamp.

The voltage divider 106 is coupled to a 1~10V DIM input to generate a DIM control voltage at the DIM input pin 3 of the ballast control IC 103. The 1~10V DIM input is an additional port to the electronic ballast. In the prior art, the 1~10V DIM input is generally coupled to an additional dial switch (wall dimmer) or a remote control means, and users have to operate the additional dial switch or the remote control means other than an existing lamp rocker switch to trigger the electronic ballast to adjust the luminance of the lamp.

Through the setting of the DIM input, the NMOS transistor 104 and the NMOS transistor 105 are periodically switched on-and-off by the high side driving signal $V_{HS}$ and the low side driving signal $V_{LS}$ respectively, and the input power is transformed from the main input voltage $V_{IN}$ to the lamp in the form of a current signal $I_{LMP}$ of which the root-mean-square value is corresponding to the setting of the DIM input.

However, since the setting of the DIM input in the prior art has to be done by manipulating an additional dial switch or a remote control means other than an existing lamp switch, users have to pay more cost for the additional dial switch or remote control means. Besides, the additional dial switch may have to be mounted on the wall wherein the wiring between the dial switch and the ballast is bothersome. As to the remote control means, the communication between the transmitter and the receiver needs power, and if the remote control means runs out of battery, then there is no way to dim the lamp unless the battery is replaced.

Therefore, there is a need to provide a solution capable of reducing the cost and eliminating the need of an additional dial switch or remote control means in implementing an electronic ballast with dimming function.

Seeing this bottleneck, the present invention proposes a novel topology of electronic ballast capable of dimming the fluorescent lamp according to the count of switching of a corresponding lamp switch, without the need of any additional dial switch or remote control means.

SUMMARY OF THE INVENTION

One objective of the present invention is to provide an electronic ballast with dimming control from power line sensing which does not need any additional dial switch or remote control means in the luminance adjustment of the lamp.

Another objective of the present invention is to provide an electronic ballast with dimming function which is triggered according to the count of switching of a corresponding lamp switch.

Still another objective of the present invention is to provide a fully integrated single chip electronic ballast with concise architecture which can control the luminance of the lamp according to the count of the switching of a corresponding lamp switch.

To achieve the foregoing objectives, the present invention provides an electronic ballast with dimming control from power line sensing for a fluorescent lamp, comprising: a line switching sensing circuit, used to generate a switching sensing signal by performing a voltage comparison operation on a DC voltage, and generate a reset signal by detecting the instance when a filtered DC voltage falls below a reset threshold level, wherein the DC voltage and the filtered DC voltage are derived from a main input voltage rectified from a power line, and the reset threshold level is above a minimum operation voltage of the electronic ballast; a control voltage generator, used to generate a control voltage according to a count of the switching sensing signal, and the control voltage generator is reset by the reset signal when the power line is turned off for a period exceeding a predetermined time; a voltage controlled oscillator, used to generate a oscillating signal according to the control voltage; and a non-overlapping driver, used to generate a high side driving signal and a low side driving signal according to the oscillating signal.

To make it easier for our examiner to understand the objective of the invention, its structure, innovative features, and performance, we use preferred embodiments together with the accompanying drawings for the detailed description of the invention.

DETAILED DESCRIPTION OF THE PREFERRED EMBODIMENTS

The present invention will be described in more detail hereinafter with reference to the accompanying drawings that show the preferred embodiment of the invention.

Figure 1:
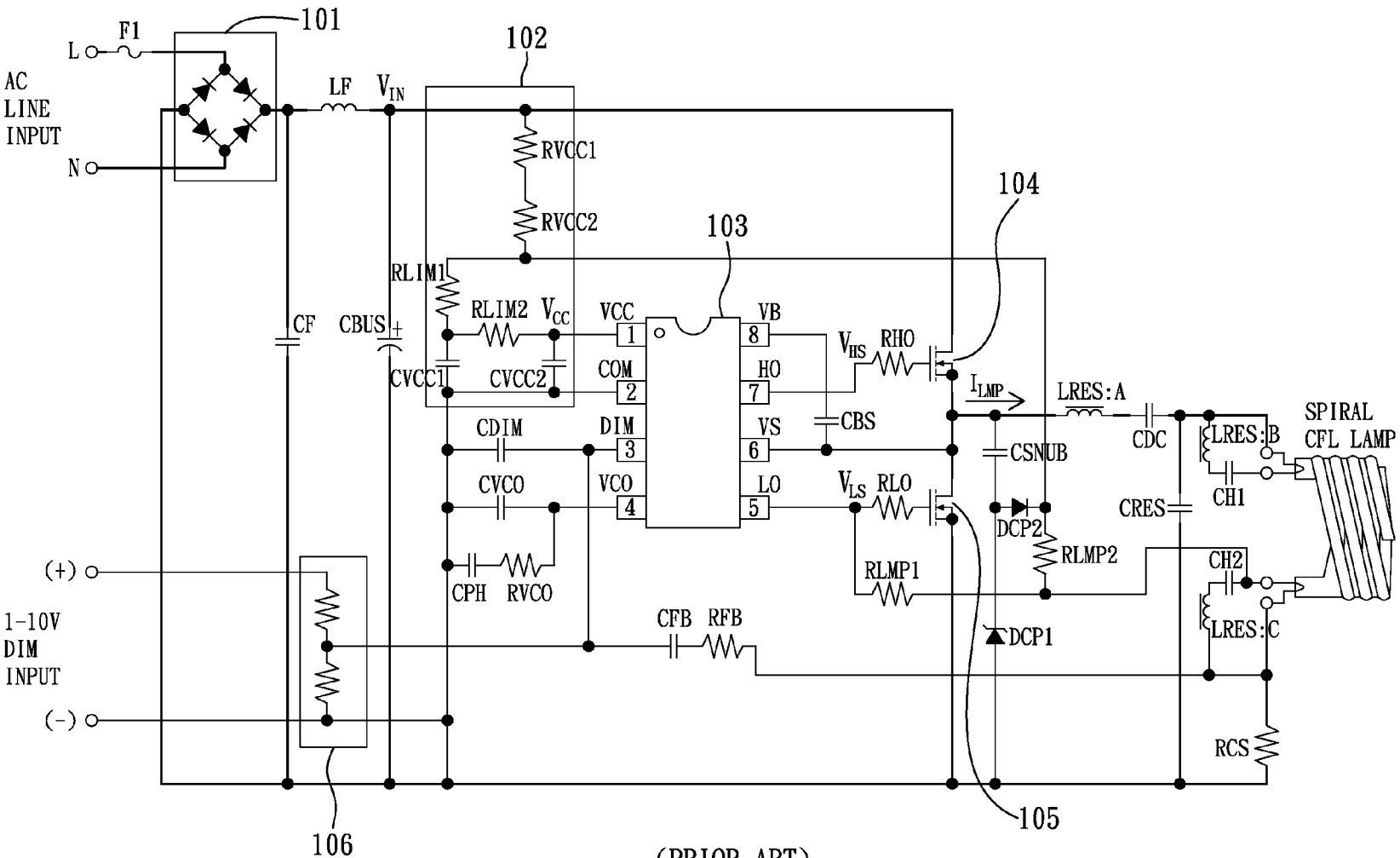
(PRIOR ART) FIG. 1
FIG. 1 is the typical architecture of a prior art electronic ballast with dimming function for driving a fluorescent lamp.
Figure 2:
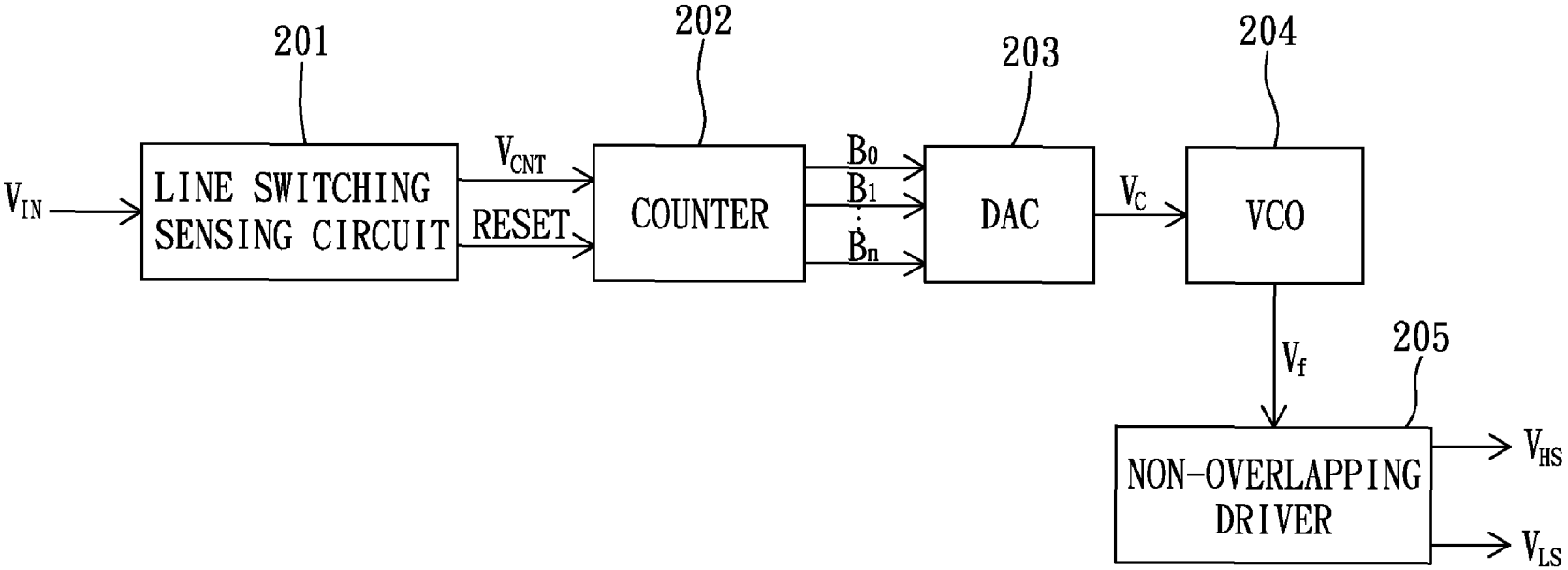
FIG. 2 is a block diagram of an electronic ballast according to a preferred embodiment of the present invention.

Please refer to FIG. 2, which shows a block diagram of a single-chip electronic ballast according to a preferred embodiment of the present invention. As shown in FIG. 2, the electronic ballast comprises a line switching sensing circuit 201, a counter 202, a digital-to-analog converter 203, a voltage controlled oscillator 204, and a non-overlapping driver 205.

The line switching sensing circuit 201 is used to generate a switching sensing signal $V_{CNT}$ by performing a first voltage comparison operation on a DC voltage derived from a main input voltage $V_{IN}$, and generate a reset signal RESET by counting the off time of the power line or by performing a second voltage comparison operation on a filtered DC voltage derived from the main input voltage $V_{IN}$, wherein the first voltage comparison operation can be implemented with a comparator or a Schmitt trigger.

The counter 202 is used to generate a digital count value $B_nB_{n-1} \ldots B_1B_0$ according to the switching sensing signal $V_{CNT}$ and the counter 202 is reset by the reset signal RESET.

The digital-to-analog converter 203 is used to generate a control voltage $V_C$ according to the digital count value $B_nB_{n-1} \ldots B_1B_0$. The digital-to-analog converter 203 together with the counter 202 forms a control voltage generator, used to generate the control voltage $V_C$ according to the digital count value $B_nB_{n-1} \ldots B_1B_0$ of the switching sensing signal $V_{CNT}$, and the control voltage generator is reset by the reset signal RESET when the off time of the power line exceeds a predetermined time.

The voltage controlled oscillator 204 is used to generate an oscillating signal $V_f$ according to the control voltage $V_C$.

Figure 5:
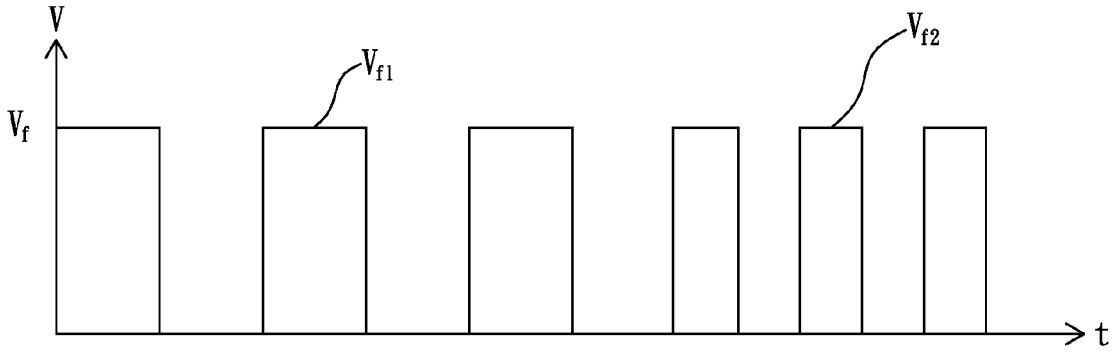
FIG. 5 is a waveform diagram of $V_f$ in FIG. 2 corresponding to two dimming levels.

The non-overlapping driver 205 is used to generate a high side driving signal $V_{HS}$ and a low side driving signal $V_{LS}$ according to the oscillating signal $V_f$, wherein the high side driving signal $V_{HS}$ and the low side driving signal $V_{LS}$ are used to drive a high side transistor and a low side transistor respectively. The waveform diagram of $V_f$ corresponding to two dimming levels is shown in FIG. 5. As shown in FIG. 5, the frequency of $V_{f1}$ is lower than that of $V_{f2}$ so $V_{f1}$ will produce larger lamp current than $V_{f2}$.

Figure 3A:
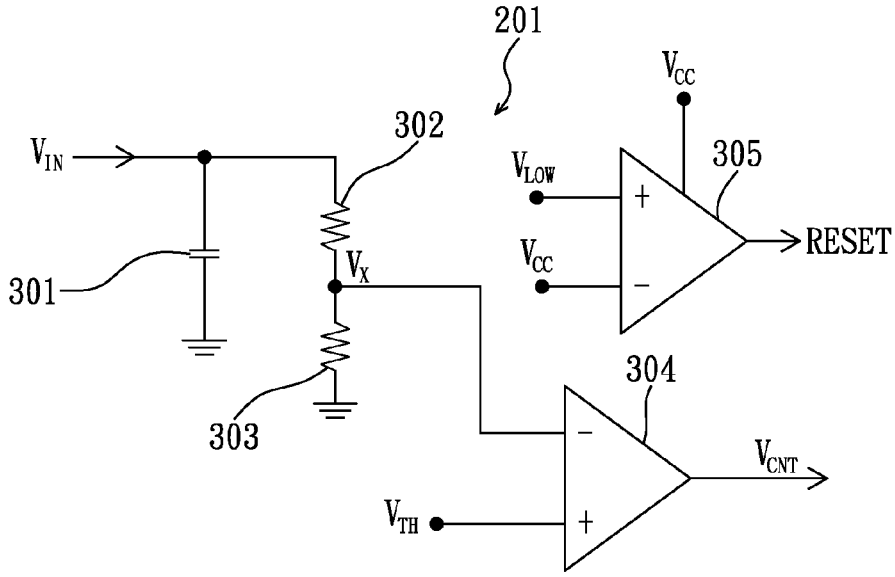
FIG. 3*a* is a block diagram of the line switching sensing circuit in FIG. 2 according to a preferred embodiment of the present invention.

Please refer to FIG. 3*a*, which shows a block diagram of the line switching sensing circuit in FIG. 2 according to a preferred embodiment of the present invention. As shown in FIG. 3*a*, the preferred embodiment of the present invention at least includes a capacitor 301, a resistor 302, a resistor 303, a comparator 304, and a comparator 305.

The capacitor 301 is used to filter out the noise of the main input voltage $V_{IN}$.

The resistor 302 and the resistor 303 are used to act as a voltage divider to generate a DC voltage $V_X$ according to the main input voltage $V_{IN}$.

The comparator 304 is used to generate the switching sensing signal $V_{CNT}$ according to a sensing threshold voltage $V_{TH}$ and the DC voltage $V_X$. The sensing threshold voltage $V_{TH}$, is preferably set, for example but not limited to 11V. FIG. 3*c* shows the resulting waveform of $V_{IN}$, $V_X$, and $V_{CNT}$ when the lamp switch is consecutively switched on and off. As shown in FIG. 3*c*, when $V_X$ falls below the sensing threshold voltage $V_{TH}$, the switching sensing signal $V_{CNT}$ will change state from low to high; when $V_X$ rises above the sensing threshold voltage $V_{TH}$, the switching sensing signal $V_{CNT}$ will change state from high to low.

The comparator 305 is used to generate the reset signal RESET according to a reset threshold voltage $V_{LOW}$ and a filtered DC voltage $V_{CC}$ for the power supply of the comparator 305, wherein the reset threshold voltage $V_{LOW}$, for example but not limited to 6V, is greater than the minimum operation voltage of the ballast controller. When the lamp switch is switched off, the main input voltage $V_{IN}$ will be pulled down immediately, but meanwhile the filtered DC voltage $V_{CC}$ is gradually decreasing due to the charge stored in a bypass capacitor for the filtered DC voltage $V_{CC}$. Therefore as the lamp switch is switched off, the filtered DC voltage $V_{CC}$ will not fall below the reset threshold voltage $V_{LOW}$ until the switch-off time exceeds a predetermined time, for example Isec, depending on the capacitance of the bypass capacitor.

Figure 3B:
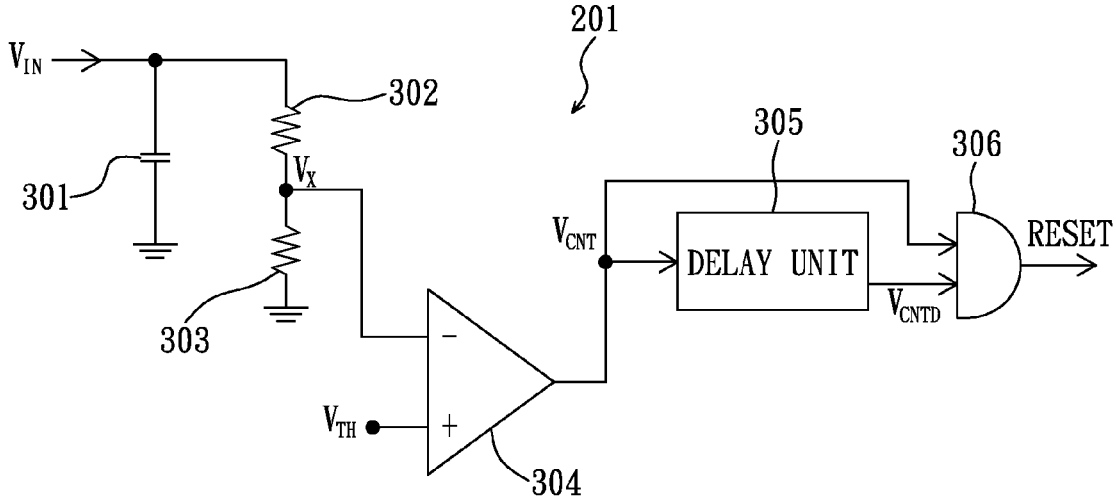
FIG. 3*b* is a block diagram of the line switching sensing circuit in FIG. 2 according to another preferred embodiment of the present invention.
Figure 3C:
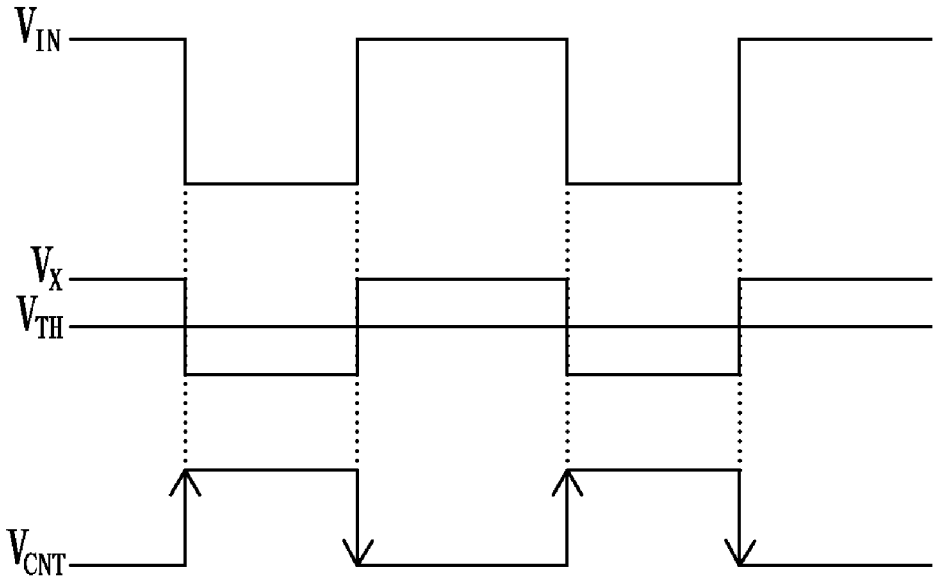
FIG. 3*c* is a waveform diagram of $V_X$ and $V_{cnt}$ in FIG. 3*a* and FIG.3*b* when the AC power is switched on and off consecutively.

Please refer to FIG. 3*b*, which shows a block diagram of the line switching sensing circuit in FIG. 2 according to another preferred embodiment of the present invention. As shown in FIG. 3*b*, the preferred embodiment of the present invention at least includes a capacitor 301, a resistor 302, a resistor 303, a comparator 304, a delay unit 305 and an AND gate 306.

The capacitor 301 is used to filter out the noise of the main input voltage $V_{IN}$.

The resistor 302 and the resistor 303 are used to act as a voltage divider to generate a DC voltage $V_X$ according to the main input voltage $V_{IN}$.

The comparator 304 is used to generate the switching sensing signal $V_{CNT}$ according to a sensing threshold voltage $V_{TH}$ and the DC voltage $V_X$. The sensing threshold voltage $V_{TH}$, is preferably set, for example but not limited to 11V. FIG. 3*c* shows the resulting waveform of $V_{IN}$, $V_X$, and $V_{CNT}$ when the lamp switch is consecutively switched on and off. As shown in FIG. 3*c*, when $V_X$ falls below the sensing threshold voltage $V_{TH}$, the switching sensing signal $V_{CNT}$ will change state from low to high; when $V_X$ rises above the sensing threshold voltage $V_{TH}$, the switching sensing signal $V_{CNT}$ will change state from high to low.

The delay unit 305 is used to delay the switching sensing signal $V_{CNT}$ with the predetermined time to generate a delayed signal $V_{CNTD}$.

The AND gate 306 is used to generate the reset signal RESET according to the switching sensing signal $V_{CNT}$ and the delayed signal $V_{CNTD}$. When the pulse width of the switching sensing signal $V_{CNT}$ is shorter than the predetermined time, the reset signal RESET will stay low; when the pulse width of the switching sensing signal $V_{CNT}$ is longer than the predetermined time, the reset signal RESET will change state to high.

Figure 4A:
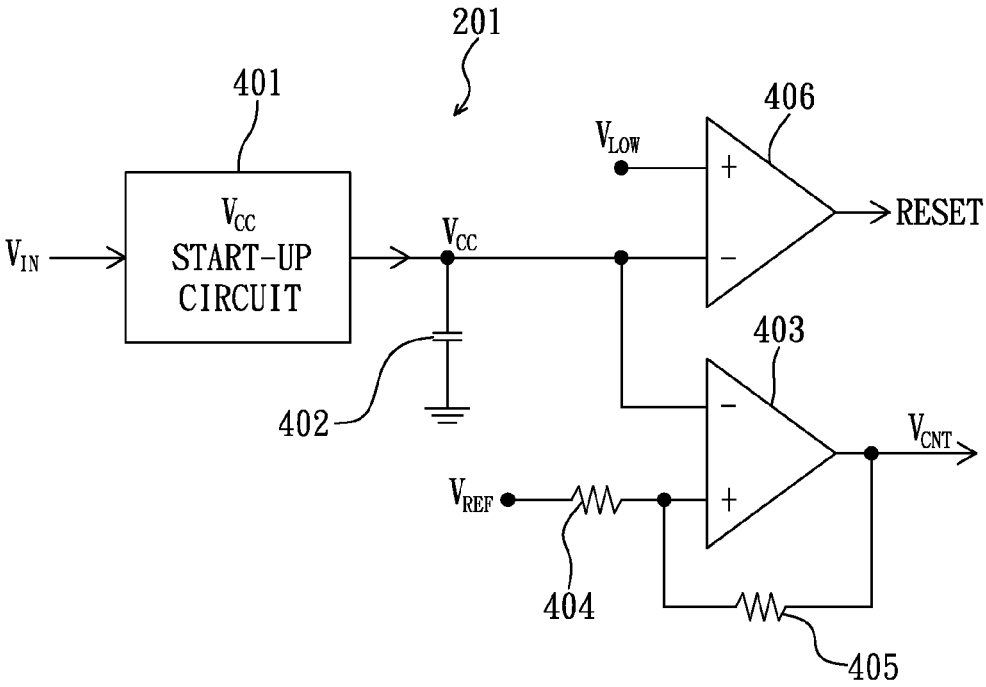
FIG. 4*a* is a block diagram of the line switching sensing circuit in FIG. 2 according to still another preferred embodiment of the present invention.

FIG. 4*a* shows a block diagram of the line switching sensing circuit in FIG. 2 according to still another preferred embodiment of the present invention. As shown in FIG. 4*a*, the preferred embodiment of the present invention at least includes a $V_{CC}$ start-up circuit 401, a bypass capacitor 402, a comparator 403, a resistor 404, a resistor 405 and a comparator 406.

The $V_{CC}$ start-up circuit 401 is used in generating the filtered DC voltage $V_{CC}$ according to the main input voltage $V_{IN}$.

The bypass capacitor 402 is used to filter out the noise of the filtered DC voltage $V_{CC}$.

The comparator 403, the resistor 404, and the resistor 405 are used to implement a Schmitt trigger to generate the switching sensing signal $V_{CNT}$ according to the voltage $V_{CC}$. The low threshold voltage of the Schmitt trigger is set according to a UVLO (Under Voltage Lock Out) turn-off level, for example but not limited to 9V, and the high threshold voltage of the Schmitt trigger is set according to a UVLO turn-on level, for example but not limited to 13V. FIG. 4*c* shows the resulting waveform of $V_{IN}$, $V_{CC}$ and $V_{CNT}$ when the lamp switch is consecutively switched on and off. When $V_{CC}$ falls below the UVLO turn-off level, the switching sensing signal $V_{cnt}$ will change state from low to high; when $V_{CC}$ rises beyond the UVLO turn-on level, the switching sensing signal $V_{CNT}$ will change state from high to low.

The comparator 406 is used to generate the reset signal RESET according to a reset threshold voltage $V_{LOW}$ and the filtered DC voltage $V_{CC}$, wherein the reset threshold voltage $V_{LOW}$, for example but not limited to 6V, is greater than the minimum operation voltage of the ballast controller. When the lamp switch is switched off, the main input voltage $V_{IN}$ will be pulled down immediately, but meanwhile the filtered DC voltage $V_{CC}$ is gradually decreasing due to the charge stored in the bypass capacitor 402 for the filtered DC voltage $V_{CC}$. Therefore as the lamp switch is switched off, the filtered DC voltage $V_{CC}$ will not fall below the reset threshold voltage $V_{LOW}$ until the switch-off time exceeds a predetermined time, for example 1 sec, depending on the capacitance of the bypass capacitor 402.

Figure 4B:
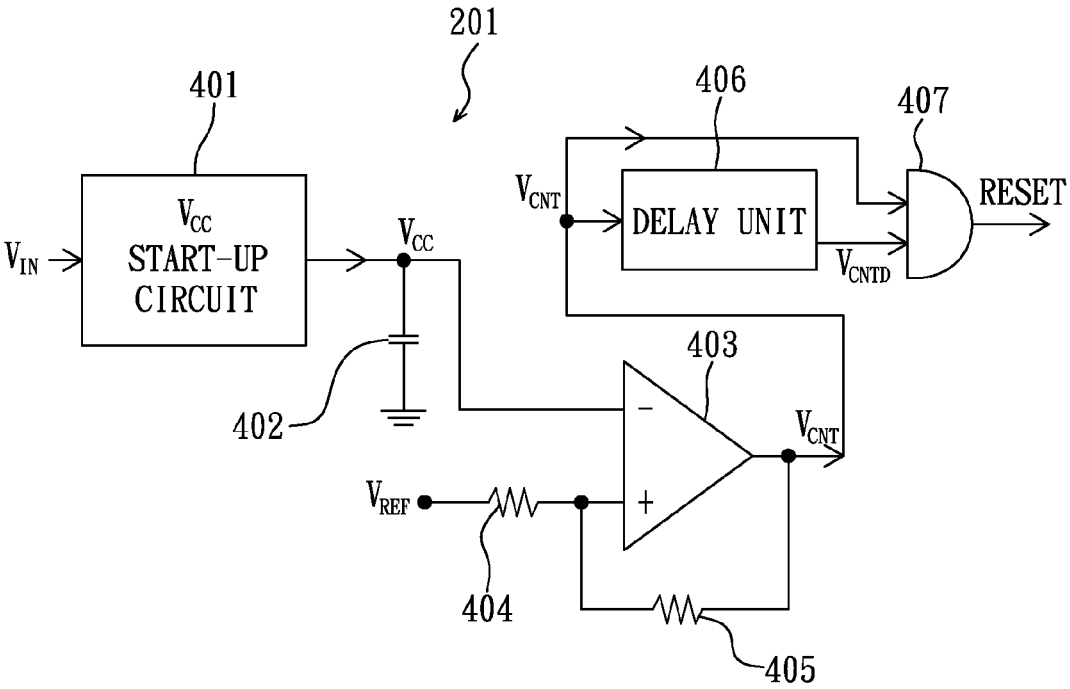
FIG. 4*b* is a block diagram of the line switching sensing circuit in FIG. 2 according to still another preferred embodiment of the present invention.
Figure 4C:
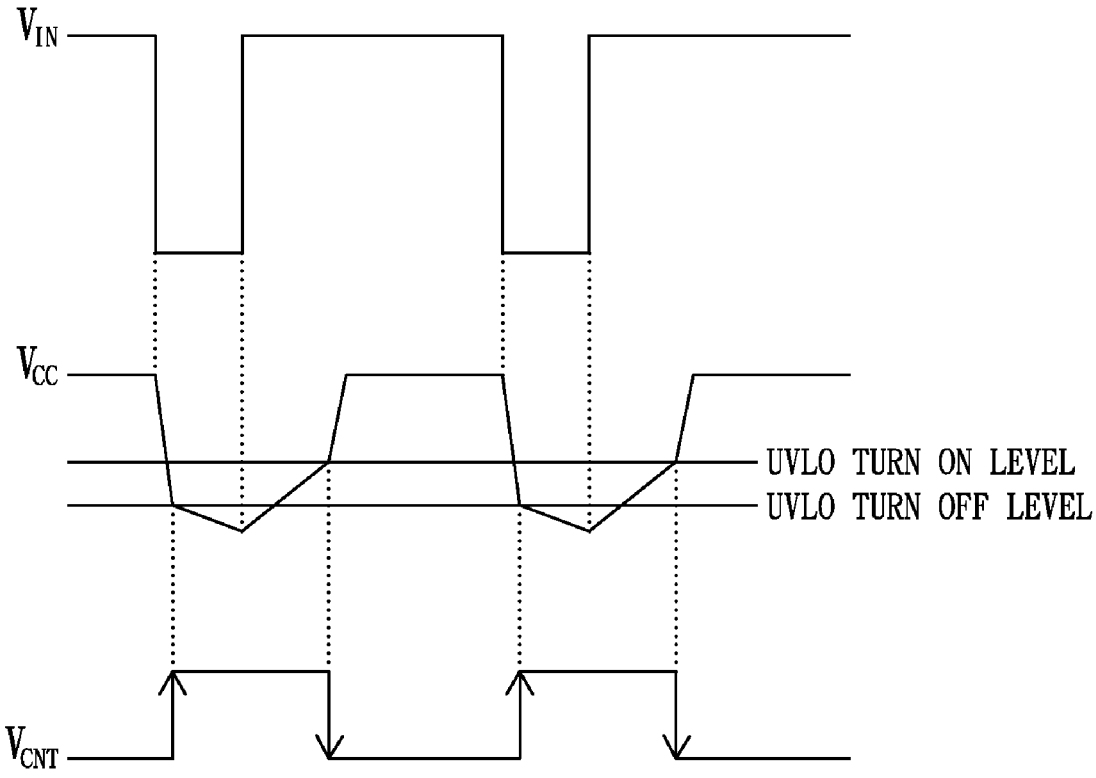
FIG. 4*c* is a waveform diagram of $V_{CC}$ and $V_{cnt}$ in FIG. 4*a* and FIG. 4*b* when the AC power is switched on and off consecutively.

FIG. 4*b* shows a block diagram of the line switching sensing circuit in FIG. 2 according to still another preferred embodiment of the present invention. As shown in FIG. 4*b*, the preferred embodiment of the present invention at least includes a $V_{CC}$ start-up circuit 401, a bypass capacitor 402, a comparator 403, a resistor 404, a resistor 405 a delay unit 406 and an AND gate 407.

The $V_{CC}$ start-up circuit 401 is used in generating the filtered DC voltage $V_{CC}$ according to the main input voltage $V_{IN}$.

The bypass capacitor 402 is used to filter out the noise of the filtered DC voltage $V_{CC}$.

The comparator 403, the resistor 404, and the resistor 405 are used to implement a Schmitt trigger to generate the switching sensing signal $V_{CNT}$ according to the voltage $V_{CC}$. The low threshold voltage of the Schmitt trigger is set according to a UVLO (Under Voltage Lock Out) turn-off level, for example but not limited to 9V, and the high threshold voltage of the Schmitt trigger is set according to a UVLO turn-on level, for example but not limited to 13V. FIG. 4*c* shows the resulting waveform of $V_{IN}$, $V_{CC}$ and $V_{CNT}$ when the lamp switch is consecutively switched on and off. When $V_{CC}$ falls below the UVLO turn-off level, the switching sensing signal $V_{cnt}$ will change state from low to high; when $V_{CC}$ rises beyond the UVLO turn-on level, the switching sensing signal $V_{CNT}$ will change state from high to low.

The delay unit 406 is used to delay the switching sensing signal $V_{CNT}$ with the predetermined time to generate a delayed signal $V_{CNTD}$.

The AND gate 407 is used to generate the reset signal RESET according to the switching sensing signal $V_{CNT}$ and the delayed signal $V_{CNTD}$. When the pulse width of the switching sensing signal $V_{CNT}$ is shorter than the predetermined time, the reset signal RESET will stay low; when the pulse width of the switching sensing signal $V_{CNT}$ is longer than the predetermined time, the reset signal RESET will change state to high.

Through the implementation of the present invention, a fully integrated single-chip electronic ballast capable of dimming control of a fluorescent lamp by sensing the count of switching of a lamp switch is presented. The topology of the present invention is much more concise than prior art circuits, so the present invention does conquer the disadvantages of prior art circuits.

While the invention has been described by way of examples and in terms of preferred embodiments, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

In summation of the above description, the present invention herein enhances the performance than the conventional structure and further complies with the patent application requirements and is submitted to the Patent and Trademark Office for review and granting of the commensurate patent rights.

What is claimed is:

1. An electronic ballast with dimming control from power line sensing for a fluorescent lamp, comprising:

a line switching sensing circuit, used to generate a switching sensing signal by performing a voltage comparison operation on a DC voltage, and generate a reset signal by detecting the instance when a filtered DC voltage falls below a reset threshold level, wherein said DC voltage and said filtered DC voltage are derived from a main input voltage rectified from a power line, and said reset threshold level is above a minimum operation voltage of said electronic ballast;

a control voltage generator, used to generate a control voltage according to a count of said switching sensing signal, and said control voltage generator is reset by said reset signal when said power line is turned off for a period exceeding a predetermined time;

a voltage controlled oscillator, used to generate a oscillating signal according to said control voltage; and a non-overlapping driver, used to generate a high side driving signal and a low side driving signal according to said oscillating signal.

2. The electronic ballast with dimming control from power line sensing as claim 1, wherein said line switching sensing circuit comprises:

a capacitor, used to filter out a noise of said main input voltage;

a voltage divider, used to generate said DC voltage according to said main input voltage;

a first comparator, used to generate said switching sensing signal according to said DC voltage and a sensing threshold voltage; and a second comparator, used to generate said reset signal according to said filtered DC voltage and a reset threshold voltage, wherein said reset threshold voltage corresponds to a level of said filtered DC voltage when said power line is turned off for a period exceeding said predetermined time.

3. The electronic ballast with dimming control from power line sensing as claim 1, wherein said line switching sensing circuit comprises:

a capacitor, used to filter out a noise of said main input voltage;

a voltage divider, used to generate said DC voltage according to said main input voltage;

a comparator, used to generate said switching sensing signal according to said DC voltage and a sensing threshold voltage; and;

a delay unit, used to delay said switching sensing signal with said predetermined time to generate a delayed signal; and an AND gate, used to generate said reset signal according to said switching sensing signal and said delayed signal.

4. The electronic ballast with dimming control from power line sensing as claim 1, wherein said line switching sensing circuit comprises:

a start-up circuit, used in generating said filtered DC voltage according to said main input voltage;

a capacitor, used to filter out a noise of said filtered DC voltage;

a Schmitt trigger, used to generate said switching sensing signal according to said filtered DC voltage, wherein said Schmitt trigger has a high threshold voltage corresponding to a UVLO turn-on level, and a low threshold voltage corresponding to a UVLO turn-off level; and a comparator, used to generate said reset signal according to said filtered DC voltage and a reset threshold voltage, wherein said reset threshold voltage corresponds to a level of said filtered DC voltage when said power line is turned off for a period exceeding said predetermined time.

5. The electronic ballast with dimming control from power line sensing as claim 1, wherein said line switching sensing circuit comprises:

a start-up circuit, used in generating said filtered DC voltage according to said main input voltage;

a capacitor, used to filter out a noise of said filtered DC voltage;

a Schmitt trigger, used to generate said switching sensing signal according to said filtered DC supply voltage, wherein said Schmitt trigger has a high threshold voltage corresponding to a UVLO turn-on level, and a low threshold voltage corresponding to a UVLO turn-off level;

a delay unit, used to delay said switching sensing signal with said predetermined time to generate a delayed signal; and an AND gate, used to generate said reset signal according to said switching sensing signal and said delayed signal.

6. The electronic ballast with dimming control from power line sensing as claim 1, wherein said control voltage generator comprises:

a counter, used to generate a digital count value according to said switching sensing signal, and said counter is reset by said reset signal when said power line is turned off for a period exceeding said predetermined time; and a digital-to-analog converter, used to generate said control voltage according to said digital count value.

7. An electronic ballast with dimming control from power line sensing for a fluorescent lamp, wherein said electronic ballast is integrated in a single chip, said electronic ballast comprising:

a line switching sensing circuit, used to generate a switching sensing signal by performing a voltage comparison operation on a DC voltage, wherein said DC voltage is derived from a main input voltage rectified from a power line;

a counter, used to generate a digital count value according to said switching sensing signal;

a digital-to-analog converter, used to generate a control voltage according to said digital count value;

a voltage controlled oscillator, used to generate a oscillating signal according to said control voltage; and a non-overlapping driver, used to generate a high side driving signal and a low side driving signal according to said oscillating signal.

* * * * *